US009879909B2

(12) United States Patent
Fissore et al.

(10) Patent No.: US 9,879,909 B2
(45) Date of Patent: Jan. 30, 2018

(54) METHOD FOR MONITORING THE SECONDARY DRYING IN A FREEZE-DRYING PROCESS

(75) Inventors: Davide Fissore, Bra (IT); Antonello Barresi, Collegno (IT); Roberto Pisano, Moretta (IT)

(73) Assignee: TELSTAR TECHNOLOGIES, S.L., Terrassa (ES)

( * ) Notice: Subject to any disclaimer, the term of this patent is extended or adjusted under 35 U.S.C. 154(b) by 1446 days.

(21) Appl. No.: 12/502,863

(22) Filed: Jul. 14, 2009

(65) Prior Publication Data

US 2010/0018073 A1 Jan. 28, 2010

(30) Foreign Application Priority Data

Jul. 23, 2008 (EP) ..... 08013243

(51) Int. Cl.
*F26B 5/06* (2006.01)

(52) U.S. Cl.
CPC ..... *F26B 5/06* (2013.01)

(58) Field of Classification Search
CPC ..... F26B 5/06
USPC ..... 34/284, 285, 290, 292, 89; 73/73, 74, 76
See application file for complete search history.

(56) References Cited

U.S. PATENT DOCUMENTS 6,176,121 B1 1/2001 Oetjen
6,971,187 B1 12/2005 Pikal et al.

FOREIGN PATENT DOCUMENTS

EP 1903291 A 3/2008

OTHER PUBLICATIONS

Kan, B, Methods of Determining Freeze-Drying Process End Points, Quartermaster Food and Container Institute For the Armed Forces, National Academy of Sciences, National Research Council, Proceedings of a Conference, Shoreland Hotel, Apr. 12-14, 1961, pp. 163-177, Chicago, Illinois.
Pikal et al., The secondary drying stage of freeze drying: drying kinetics as a function of temperature and chamber pressure, International Journal of Pharmaceutics, 60 (1990) 203-217.
Sheehan et al., Modeling of the Primary and Secondary Drying Stages of the Freeze Drying of Pharmaceutical Products in Vials: Numerical Results Obtained from the Solution of a Dynamic and Spatially Multi-Dimensional Lyophilization Model for Different Operational Policies, Biotechnology and Bioengineering, vol. 60, No. 6, Dec. 20, 1998, 712-728.
Sadikoglu et al., Optimal Control of the Primary and Secondary Drying Stages of Bulk Solution Freeze Drying in Trays, Drying Technology, 16:3, 399-431.

*Primary Examiner* — Jessica Yuen
(74) *Attorney, Agent, or Firm* — Silvia Salvadori, P.C.; Silvia Salvadori

(57) ABSTRACT

A method to monitor a secondary drying phase of a freeze-drying process comprises initial steps in which is provided to perform pressure rise tests at different time and to calculate a respective value of experimental desorption rate of product (steps 1 to 3). Subsequently, the method provides to estimate initial conditions and kinetic constants of a kinetic model of the process (step 4) and to calculate at time $t=t_2$ a respective residual moisture content and a respective desorption rate (step 5). The method can be performed in a freeze-dryer apparatus which includes a drying chamber that contains a product to be dried and can be isolated to perform pressure rise tests.

17 Claims, 5 Drawing Sheets

Freeze-dryer (Lyophilizer) schematics

Freeze-dryer (Lyophilizer)
schematics

METHOD FOR MONITORING THE SECONDARY DRYING IN A FREEZE-DRYING PROCESS

CROSS REFERENCE TO RELATED APPLICATION

This application is a new U.S. utility application claiming priority benefit of EP 08013243.4, filed Jul. 23, 2008, the entire contents of which are hereby incorporated by reference. The invention relates to methods for monitoring a freeze-drying process in a freeze-dryer; in particular it refers to a method for monitoring secondary drying of a freeze-drying process, for example, of pharmaceutical products arranged in containers.

BACKGROUND OF THE INVENTION

Freeze-drying, also known as lyophilization, is a dehydration process that enables removal by sublimation of water and/or solvents from a substance, such as food, pharmaceutical or biological products. Typically the freeze-drying process is used to preserve a perishable product since the greatly reduced water content that results inhibits the action of microorganisms and enzymes that would normally spoil or degrade the product. Furthermore, the process makes the product more convenient for transport. Freeze-dried products can be sealed in containers to prevent the reabsorption of moisture and can be easily rehydrated or reconstituted by addition of removed water and/or solvents. In this way the product may be stored at room temperature without refrigeration, and be protected against spoilage for many years.

Since freeze-drying is a low temperature process in which the temperature of product does not exceed typically 30° C. during the operating phases, it causes less damage or degradation to the product than other dehydration processes using higher temperatures. Freeze-drying does not usually cause significant shrinkage or toughening of the product being dried. Freeze-dried products can be rehydrated much more quickly and easily because of the porous structure created during the sublimation of ice.

In the pharmaceutical field, freeze-drying process is widely used in the production of pharmaceuticals, mainly for parenteral and oral administration, also because freeze-drying process can be carried out in sterile conditions.

A known freeze-dryer apparatus for performing a freeze-drying process usually comprises a drying chamber and a condenser chamber interconnected by a duct that is provided with a valve that allows isolating the drying chamber when required during the process.

FIG. 1 shows the drying chamber which comprises a plurality of temperature-controlled shelves arranged for receiving containers of product to the dried. The condenser chamber includes condenser plates or coils having surfaces maintained at very low temperature, e.g. −50° C., by means of a refrigerant of freezing device. The condenser chamber is also connected to one or more vacuum pumps so as to achieve high vacuum values inside both chambers.

Freeze-drying process typically comprises three phases: a freezing phase, a primary drying phase and a secondary drying phase.

During the freezing phase the shelf temperature is reduced up to typically −30/−40° C. in order to convert into ice most of the water and/or solvents contained in the product.

In the primary drying phase the shelf temperature is increased, while the pressure inside the drying chamber is lowered below 1-5 mbar so as to allow the frozen water and/or solvents in the product to sublime directly from solid phase to gas phase. The application of high vacuum makes possible the water sublimation at low temperatures.

Heat is supplied to the product and the vapour generated by sublimation of frozen water and/or solvents is removed from the drying chamber by means of condenser plates or coils of condenser chamber wherein the vapour can be re-solidified.

Secondary drying phase is provided for removing by desorption the residual moisture of the product, namely the amount of unfrozen water and/or solvents that cannot be removed during primary drying when sublimation of ice takes place. During this phase the shelf temperature is further increased up to a maximum of 30-60° C. to heat the product, while the pressure inside the drying chamber is set typically below 0.1 mbar.

At the end of secondary drying phase the product is sufficiently dried with residual moisture content typically of 1-3%.

Secondary drying has to be carefully monitored in order to point out when the drying process is completed, i.e. when the desired amount of residual moisture in the product has been achieved.

There are known methods for monitoring secondary drying phase.

According to a known method the residual moisture of the product can be determined by extracting samples from the freeze-dryer without interrupting the freeze-drying (e.g. using a "sample thief") and measuring off-line their moisture content by means of Karl Fischer titration, thermal gravimetric analysis, or near Infra-Red spectroscopy.

U.S. Pat. No. 6,971,187 proposes another method wherein the estimation of the drying rate of the product during the secondary drying is obtained by performing a Pressure Rise Test (PRT).

During a PRT the drying chamber is isolated from the condenser chamber by closing the valve positioned in the duct connecting the two chambers. As the heating is not stopped, the ice sublimation continues, thus increasing in the drying chamber the pressure that can be measured.

Given the curve of pressure vs. time, the slope at the beginning of this curve allows estimating the flow rate of water and/or solvent from the product by the equation:

$$\left.\frac{dP}{dt}\right|_{t=t_0} = \frac{RT}{V} j_{w,n} \qquad \text{(eq. 1)}$$

where:

P: measured pressure, [Pa]

t: time, [s]

$t_0$: time instant at the beginning of the PRT, [s]

R: gas constant [8.314 J $mol^{-1}$ $K^{-1}$]

T: temperature of the vapour, [K]

V: (free) volume of the chamber, [$m^3$]

$j_{w,n}$: flow rate of water and/or solvent from the product, [mol $s^{-1}$]

Thus, the mass flow of water and/or solvent can be calculated:

$$j_{w,m} = M_w \frac{V}{RT} \left.\frac{dP}{dt}\right|_{t=t_0} \qquad \text{(eq. 2)}$$

where:

$j_{w,m}$: mass flow of water and/or solvent from the product, [kg $s^{-1}$]

$M_w$: molecular weight of water and/or solvent, [kg $mol^{-1}$]

From this value, the loss in water and/or solvent during the measurement period elapsed between two consecutive PRTs can be estimated by:

$$\Delta w_{m,j} = j_{w,m,j-1} \Delta t_j \quad \text{(eq. 3)}$$

where:

$t_j = t_j - t_{j-1}$ time elapsed between j-th PRT and (j−1)th PRT, [s]

$w_{m,j}$: loss in water during the time interval $t_j$, [kg]

$j_{w,m,j-1}$: mass flow of water and/or solvent from the product calculated from the (j−1)-th PRT, [kg $s^{-1}$].

The total amount of water and/or solvent removed between a reference time $t_0$ (e.g. the start of the secondary drying) and any given time of interest $t_j$ is simply the summation of all the $w_{m,j}$ occurring in the various intervals between PRTs. Exploiting one independent experimental value for detecting the residual water content at a reference time, e.g. at the end of primary drying, the real time actual moisture content vs. time can be calculated. This requires extracting a sample from the drying chamber or using expensive sensors (e.g. NIR-based sensors) to get this value in-line.

Given this experimental value, some empirical or common sense indications are given to calculate the "optimal" temperature to minimize the time required to complete the secondary drying.

A disadvantage of the above known methods consists in that they require extracting samples from the drying chamber and using expensive sensors for measuring the experimental values of residual water and/or solvent. Samples extraction is an invasive operation that perturbs the freeze-drying process and thus it is not suitable in sterile and/or aseptic processes and/or when automatic loading/unloading of the containers is used. Furthermore, sample extraction is time consuming and requires skilled operators.

Another disadvantage of the method disclosed in U.S. Pat. No. 6,971,187 is that the empirical and common sense indications used for calculating the "optimal" temperature do not allow to optimize the process.

A different approach is disclosed in U.S. Pat. No. 6,176,121 wherein using two successive measurements of desorption rate (DR), i.e. the mass flow rate of the water and/or solvent vapour due to desorption, calculated from $j_{w,m}$, it is possible to extrapolate the point in time at which a given small value of DR is obtained. In order to do this, the valve placed between the drying chamber and the condenser chamber should be regularly closed for a certain time and the pressure rise curve (PRC), caused by the desorbing water vapour, has to be acquired. Thus, the mass of desorbed water and/or solvent over the time, or rather the desorption rate, can be calculated from the initial slope of the PRC as follows:

$$DR_{exp} = \frac{VM_w}{RT}\left(\frac{dP}{dt}\right)_{t=t_0}\frac{100}{m_{dried}} \quad \text{(eq. 4)}$$

where:

$m_{dried}$: mass of the dried product, [kg]

$DR_{exp}$: experimental desorption rate, [% of water and/or solvent over dried product $s^{-1}$]

A disadvantage of this method consists in that, due to the very simplified approach, it is shown to fail in correspondence of the end of secondary drying. Moreover, it does not allow to estimate the absolute residual moisture, but only the difference with respect to the equilibrium moisture, which depends on the operating conditions (shelf temperature and drying chamber pressure), and therefore no target about this value can be set.

An object of the invention is to improve the methods for monitoring a freeze-drying process in a freeze-dryer, particularly for monitoring a secondary drying phase of said freeze-drying process.

A further object is to provide a method for calculating process parameters, such as residual moisture content and/or desorption rate of a dried product, that is non-invasive and not-perturbing the freeze-drying process and thus is suitable for being used in sterile and/or aseptic processes and/or when automatic loading/unloading of the containers is used.

Another object is to provide a method capable to precisely estimate initial conditions and kinetic constants of a kinetic model of the drying process, suitable for calculating the process parameters.

Still another object is to provide a method for estimating in a reliable and precise way a residual moisture concentration and/or desorption rate of the dried product during secondary drying phase and a time required for terminating said secondary drying phase.

Another further object is to provide a method wherein estimation of process parameters is progressively improved and refined during progress of secondary drying phase, said estimation being nevertheless good with respect to known methods even at the beginning of secondary drying phase.

BRIEF DESCRIPTION OF THE DRAWINGS

The invention can be better understood and carried into effect with reference to the enclosed drawings, that show an embodiment of the invention by way of non-limitative example, in which.

DESCRIPTION OF THE INVENTION

Figure 1:
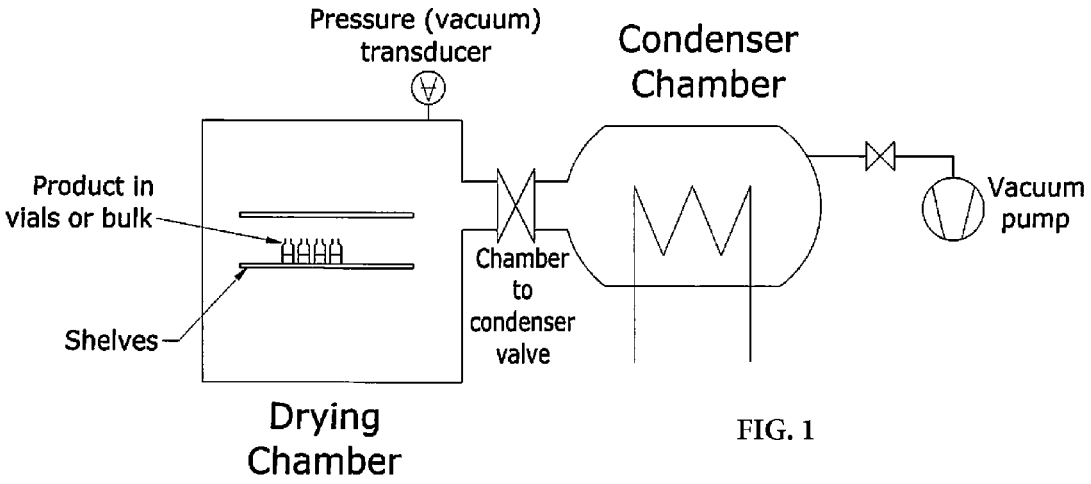
FIG. 1 is a freeze-dryer apparatus for performing a freeze-drying process.

According to the invention, a method is provided for monitoring a secondary drying phase of a freeze-drying process in a freeze-dryer apparatus including a drying chamber that contains a product to be dried and can be isolated for performing pressure rise tests, said method comprising the steps of:

performing a first pressure rise test at time $t=t_0$ and calculating a first value of experimental desorption rate of said product (step 1);

performing a second pressure rise test at time $t=t_1$ and calculating a second value of experimental desorption rate of said product (step 2);

performing a third pressure rise test at time $t=t_2$ and calculate a third value of experimental desorption rate of said product (step 3);

estimating initial conditions and kinetic constants of a kinetic model of the drying process, said kinetic model being suitable for calculating a residual moisture content and/or a desorption rate of said product (step 4);

calculating at time $t=t_2$ a respective residual moisture content and a respective desorption rate (step 5).

The method further comprises, after step 5, the step of:

comparing said residual moisture content and/or said desorption rate calculated at time $t=t_2$ respectively with a desired final residual moisture concentration and/or a desired final desorption rate (step 6); if said residual moisture content is lower than, or equal to, said final residual moisture concentration or said desorption rate is lower than, or equal to, said final desorption rate, then the secondary drying phase is considered ended; if not the method further comprising the steps of:

estimating a final time at which said final residual moisture concentration or said final desorption rate is obtained (step 7);

performing a further pressure rise at time $t=t_j$ and calculating at said time $t=t_j$ a respective residual moisture content and a respective desorption rate (step 8);

estimating initial conditions and kinetic constants of said kinetic model (step 9);

calculating at said time $t=t_j$ said respective residual moisture content and/or said respective desorption rate (step 10);

comparing said residual moisture content and/or said desorption rate calculated at said time $t=t_j$ respectively with said final residual moisture concentration and/or said final desorption rate (step 11); if said residual moisture content is lower than, or equal to, said final residual moisture concentration or said desorption rate is lower than, or equal to, said final desorption rate then the secondary drying phase is considered ended; if not step 7 to 11 are repeated.

Owing to the invention it is possible to obtain a method for calculating in a reliable and precise way the residual moisture concentration and/or desorption rate of a dried product during a secondary drying phase of a freeze-drying process. The method is also capable to precisely estimate initial conditions and kinetic constants of a kinetic model of the drying process, which calculates the residual moisture concentration and/or desorption rate process, without extracting any samples from the drying chamber and without using expensive sensors to get this value in-line. Thus, the monitoring method of the invention is non-invasive and non-perturbing the freeze-drying process and is suitable for being used in sterile and/or aseptic processes and/or when automatic loading/unloading of the containers is used.

Furthermore, the method allows calculating the time required for terminating said secondary drying phase, wherein the stop requirement can be that the residual moisture concentration, or the desorption rate, has a respective desired final value.

Since the steps of the method are iterated till the end of secondary drying phase is reached, estimation of process parameters is progressively improved and refined during progress of secondary drying phase, said estimation being nevertheless good with respect to known methods even at the beginning of secondary drying phase.

The method of the invention monitors a secondary drying phase of a freeze-drying process in a freeze-dryer. In particular, the method calculates the residual moisture content of a dried product and provides a reliable estimation of the time that is necessary to complete this phase, according to the desired target (final moisture content and/or final value of desorption rate).

The method requires performing periodically a Pressure Rise Test (PRT) and thus can be applied to those freeze-drying processes that are carried out in freeze-dryers comprising a drying chamber, where the product to be dried is placed, and a separate condenser chamber, where the vapour generated by drying process flow and can be re-solidified or frozen.

The PRT is carried out by closing for a short time interval (from few tens of seconds, e.g. 30 s, to few minutes) a valve that is placed on the duct that connects drying chamber to condenser chamber and measuring (and recording) the time evolution of the total pressure in the chamber.

From the slope of the curve at the beginning of the test the current water and/or solvent desorption rate (DR, % $s^{-1}$) can be calculated. The PRT is repeated every pre-specified time interval (e.g. 30 minutes) in order to know the time evolution of the water and/or solvent desorption rate. The time interval can be constant or can be changed during the operation.

All the methods based on the PRT for monitoring the primary drying step of a freeze-drying process take advantage from the fact that, during the test, the pressure in the drying chamber increases until equilibrium is reached. As this is not the case for secondary drying (due to the low values of the flow rate of water and/or solvent), the only information that can be exploited from PRT is the estimation of the water and/or solvent flow rate, that can thus be integrated in order to evaluate the water and/or solvent loss in time. The estimation of the moisture content requires knowing the initial moisture concentration, which is calculated according to the method of the invention, as described in detail in the following, without extracting any samples from the drying chamber and without using expensive sensors to get this value in-line. In other words, the monitoring method is non-invasive and non-perturbing the freeze-drying process and thus is suitable for being used in sterile and/or aseptic processes and/or when automatic loading/unloading of the containers is used.

The method of the invention requires modelling the dependence of the Desorption Rate (DR) on the residual moisture content ($C_S$) in the dried product. Various known mathematical equations can be used to this purpose. The method comprises an algorithm able to work efficiently whichever correlation is used.

Various kinetic models have been proposed to model the desorption rate of water and/or solvent. The desorption rate can be assumed to depend on the residual moisture content, or on the difference between the residual moisture content and the equilibrium value.

Both types of models have been demonstrated to perform more or less in the same way; moreover, there is uncertainty about the real physical mechanism of water and/or solvent desorption that may depend on the product considered.

In a first version of the method, the desorption rate DR is assumed to depend on the residual moisture $C_S$ in the solid matrix of the dried product, according to equation:

$$DR=-kC_S \quad \text{(eq. 5)}$$

the time evolution of the residual moisture $C_s$, given in % of water and/or solvent per dried mass, can be calculated by the integration of the following differential equation:

$$\frac{dC_S}{dt} = DR = -kC_S \quad \text{(eq. 6)}$$

where t is the time [s] and k is the kinetic constant of the process [$s^{-1}$].

The kinetic constant can be a function of the temperature and, thus, it can change with time as the temperature of the product can change with time, in particular at the beginning of the secondary drying when the temperature is risen from the value used during primary drying to that of the secondary drying.

If a PRT is made at time $t=t_{j-1}$ and the successive PRT is made at time $t=t_j$ and the product temperature, that is slightly varying in the interval $[t_j-t_{j-1}]$, is assumed to be constant and equal to a mean value, the variation of the moisture concentration in the solid can be described by the equation:

$$\frac{dC_S}{dt} = DR_j = -k_jC_S \quad \text{(eq. 7)}$$

The solution of eq. 7 requires the initial condition, i.e. the value of the residual moisture $C_S$ at time $t=t_{j-1}$:

$$C_S=C_{S_{j-1}}e^{-k_j(t-t_{j-1})} \quad \text{(eq. 8)}$$

The value of $C_{S,j-1}$ can be calculated from the time integration of eq. 6 in the previous time interval:

$$C_{S_{j-1}}=C_{S,j-2}e^{-k_{j-1}(t_{j-1}-t_{j-2})} \quad \text{(eq. 9)}$$

and thus:

$$C_S=C_{S,j-2}e^{-k_{j-1}(t_{j-1}-t_{j-2})}e^{-k_j(t-t_{j-1})} \quad \text{(eq. 10)}$$

This procedure can be iterated until the value $C_{S,0}$ of the residual moisture at the beginning of the secondary drying phase ($t=t_0$) appears. Thus, in the time interval between $t_j$ and $t_{j-1}$ the evolution of the residual moisture concentration is given by:

$$C_S = C_{S,0}\prod_{i=1}^{j-1} e^{-k_i(t_i-t_{i-1})}e^{-k_j(t-t_{j-1})} \quad \text{(eq. 11)}$$

The solution of eq. 11 requires the value of initial moisture concentration $C_{S,0}$.

The evolution of the theoretical value of the desorption rate in the time interval between $t_j$ and $t_{j-1}$ is thus given by:

$$DR_{theor} = -k_jC_{S,0}\prod_{i=1}^{j-1} e^{-k_i(t_i-t_{i-1})}e^{-k_j(t-t_{j-1})} \quad \text{(eq. 12)}$$

If $C_{S,0}$ and the values of the various $k_j$ are perfectly known and the model given by eq. 6 is adequate to describe the dynamics of the system, eq. 11 can be used to know the time evolution of the residual moisture content and thus the time that is required to fulfill the requirements on the final value of the moisture content in the product. If the requirement is on the value of the desorption rate, eq. 12 can be used to this purpose.

The above situation is quite rare, since the value of initial moisture concentration has to be measured by extracting samples and the various kinetic constants are never known a priori.

Figure 2:
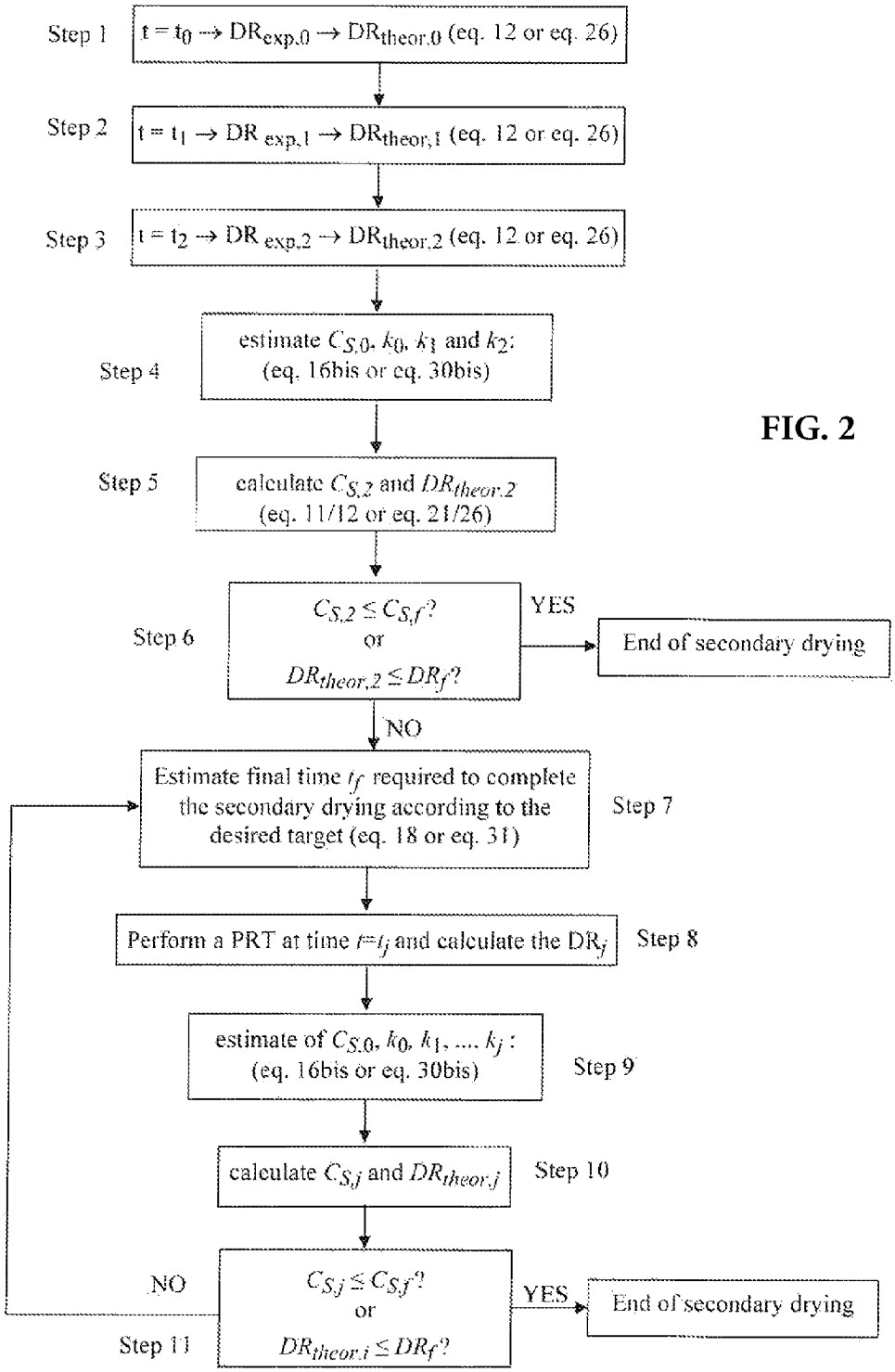
FIG. 2 is a flowchart schematically showing the method of the invention for monitoring a secondary drying phase in a freeze-drying process.

The method according to the invention provides calculating initial condition $C_{s,0}$ and kinetic constants performing the following steps as shown in the flowchart of FIG. 2.

Step 1

At time $t=t_0$ a PRT is performed and a respective desorption rate DR (indicated in the following as $DR_{exp,0}$) is calculated, i.e. using eq. 4.

From eq. 12 it is:

$$DR_{exp,0}=DR_{theor,0}=-k_0C_{S,0} \quad \text{(eq. 13)}$$

Step 2

At time $t=t_1$ a PRT is performed and a respective desorption rate DR (indicated in the following as $DR_{exp,0}$) is calculated, i.e. using eq. 4.

From eq. 12 it is:

$$DR_{exp,1}=DR_{theor,1}=-k_1C_{S,0}e^{-k_1(t_1-t_0)} \quad \text{(eq. 14)}$$

Step 3

At time $t=t_2$ a PRT is performed and the desorption rate DR (indicated in the following ad $DR_{exp,2}$) is calculated, i.e. using eq. 4.

From eq. 12 it is:

$$DR_{exp,2}=DR_{theor,2}=-k_2C_{s,0}e^{-k_1(t_1-t_0)}e^{-k_2(t_2-t_1)} \quad \text{(eq. 15)}$$

Step 4

Values of $C_{S,0}$, $k_0$, $k_1$ and $k_2$ are estimated so that the calculated values of the desorption rate matches with all the experimental values available ($DR_{exp,0}$, $DR_{exp,1}$ and $DR_{exp,2}$). This can be done using a minimization algorithm to solve the following non-linear least-square problem:

$$\min_{C_{S,0},k_i} \sum_{i=0}^{2} (DR_{exp,i} - DR_{theor,i})^2 \quad \text{(eq. 16)}$$

and assuming, for example, that $k_2$ is equal to $k_1$, due to fact that the time interval between two PRTs is generally small, e.g. 30 minutes, and to fact that the temperature of the product is almost constant during secondary drying (only at the beginning of secondary drying the temperature of the product varies, from that of primary drying to that required by secondary drying, but this variation is generally slow, due to the thermal inertia of the system).

As starting values for eq. 16 it is possible to use the rough approximations of $k_0$, $k_1$ and $C_{S,0}$ that can be calculated from eq. 13 and eq. 14 after the first two PRTs:

$$k_0 = k_1 = -\frac{1}{t_1 - t_0}\ln\frac{DR_{exp,1}}{DR_{exp,0}} \quad \text{(eq. 17)}$$

$$C_{S,0} = \frac{DR_{exp,0}}{\frac{1}{t_1 - t_0}\ln\frac{DR_{exp,1}}{DR_{exp,0}}}$$

These values are just a first approximation of the kinetic constants $k_0$ and $k_1$ and of residual moisture content $C_{S,0}$; these estimations will be refined after each PRT.

Step 5

Once estimated the values of $C_{S,0}$, $k_0$, $k_1$ and $k_2$, at time $t=t_2$ it is calculated the residual moisture concentration $C_{S,2}$, using eq. 11, or the desorption rate $DR_{theor,2}$, using eq. 12.

Step 6

The calculated residual moisture concentration $C_{S,2}$, or desorption rate $DR_{theor,2}$, is compared with a desired value of final or target residual moisture concentration $C_{s,f}$, or a desired value of final or target desorption rate $DR_f$.

If the calculated residual moisture concentration $C_{S,2}$, or desorption rate $DR_{theor,2}$, is lower than, or equal to, the final residual moisture concentration $C_{S,f}$, or final desorption rate $DR_f$, then the secondary drying phase is completed.

Step 7

If the calculated residual moisture concentration $C_{S,2}$ is higher than the final residual moisture concentration $C_{S,f}$, or the calculated desorption rate $DR_{theor,2}$ is higher than the final desorption rate $DR_f$, then using the calculated values of $C_{S,0}$ and of kinetic constants $k_0$, $k_1$ and $k_2$, it is possible to estimate the final time $t_f$ at which the desired residual moisture concentration $C_{S,f}$, or final desorption rate $DR_f$, is obtained, assuming that the temperature of the product does not change. This can be done by using eq. 11 where $C_S$ is replaced by $C_{S,f}$ and, thus, t corresponds to $t_f$:

$$t_f = t_2 - \frac{1}{k_2}\ln\left(\frac{C_{S,f}}{C_{S,2}}\right) \quad \text{(eq. 18)}$$

A different stop criterion can be assumed, e.g. the requirement that the desorption rate has a certain low value. For this purpose eq. 12 can be used where DR is replaced by the target value and, thus, t corresponds to $t_f$.

Step 8

A new PRT is performed at time $t=t_j$ and a respective desorption rate $DR_{exp,j}$ is calculated; from eq. 12:

$$DR_{exp,j} = DR_{theor,j} = -k_j C_{S,0}\prod_{i=1}^{j-1} e^{-k_i(t_i-t_{i-1})}e^{-k_j(t_j-t_{j-1})} \quad \text{(eq. 15bis)}$$

This step can be repeated several times, as better explained in the following, and after each PRT a new value of DR is available and a better estimation of the values of $C_{S,0}$, $k_0$, $k_1$, . . . , $k_j$ and $t_f$ is obtained, until the end of the secondary drying phase.

For example, at time $t=t_3$ the PRT gives $DR_{exp,3}$ and from eq. 12 it follows:

$$DR_{exp,3} = DR_{theor,3} = -k_3 C_{s,0} e^{-k_1(t_1-t_0)}e^{-k_2(t_2-t_1)}e^{-k_3(t_3-t_2)} \quad \text{(eq. 15ter)}$$

Step 9

Values of constants $C_{S,0}$, $k_0$, $k_1$, . . . , $k_j$ are estimated by solving the non-linear least-square problem:

$$\min_{C_{S,0},k_i} \sum_{i=0}^{j} (DR_{exp,i} - DR_{theor,i})^2 \quad \text{(eq. 16bis)}$$

assuming, for example, that $k_j$ is equal to $k_{j-1}$, as previously stated.

For example, at time $t=t_3$, the values of constants $C_{S,0}$, $k_0$, $k_1$, $k_2$ and $k_3$ are calculated by solving the non-linear least-square problem:

$$\min_{C_{S,0},k_i} \sum_{i=0}^{3} (DR_{exp,i} - DR_{theor,i})^2 \quad \text{(eq. 16ter)}$$

Step 10

Once estimated the values of $C_{S,0}$, $k_0$, $k_1$, . . . , $k_j$, it is possible to calculate at time $t=t_j$ the residual moisture concentration $C_{S,j}$, using eq. 11, or the desorption rate $DR_{theor,j}$, using eq. 12. For example, at time $t=t_3$, once estimated the values of $C_{S,0}$, $k_0$, $k_1$, $k_2$ and $k_3$, it is possible to calculate the residual moisture concentration $C_{S,3}$ or the desorption rate $DR_{theor,3}$.

Step 11

The calculated value of residual moisture concentration $C_{S,3}$, or desorption rate $DR_{theor,3}$, are compared at time $t=t_j$ with the final residual moisture concentration $C_{S,f}$, or the final desorption rate $DR_f$.

If the calculated residual moisture concentration $C_{S,j}$, or desorption rate $DR_{theor,j}$, is lower than, or equal to, the final residual moisture concentration $C_{S,f}$, or the final desorption rate $DR_f$, then the secondary drying phase is terminated.

If the calculated residual moisture concentration $C_{S,j}$, or desorption rate $DR_{theor,j}$, is higher than the final residual moisture concentration $C_{S,f}$, or the final desorption rate $DR_f$, than step 7 is repeated with $t=t_j$ for estimating the final time $t_f$ at which the final residual moisture concentration $C_{S,f}$, or final desorption rate $DR_f$, is obtained:

$$t_f = t_j - \frac{1}{k_j}\ln\left(\frac{C_{S,f}}{C_{S,j}}\right) \quad \text{(eq. 18bis)}$$

For example, at time $t=t_3$ it is possible to estimate the final time $t_f$ at which the desired residual moisture concentration $C_{S,f}$, or final desorption rate $DR_f$, is obtained, assuming that the temperature of the product does not change. This can be done by using eq. 11 where $C_S$ is replaced by $C_{S,f}$ and, thus, t corresponds to $t_f$:

$$t_f = t_3 - \frac{1}{k_3}\ln\left(\frac{C_{S,f}}{C_{S,3}}\right) \quad \text{(eq. 18ter)}$$

A different stop criterion can be assumed, i.e. the requirement that the desorption rate has a certain final low value. For this purpose eq. 12 can be used where DR is replaced by the target value and, thus, t corresponds to $t_f$.

Steps 7 to 11 are repeated till the end of secondary drying phase is reached, i.e. till the estimated value of residual moisture concentration $C_{s,j}$, or desorption rate $DR_{theor,j}$ at time $t_j$, is lower than, or equal to, the desired value of residual moisture concentration $C_{S,f}$, or desorption rate $DR_f$.

In a second version of the method, the desorption rate DR is assumed to depend on the difference between the residual moisture content $C_S$ in the solid matrix of the dried product and the equilibrium moisture concentration $C_{S,eq}$:

$$DR=-k(C_S-C_{S,eq}) \quad \text{(eq. 19)}$$

The equilibrium moisture concentration $C_{s,eq}$ is an additional parameter, the value of which can be known (it must be determined experimentally).

Starting from this different expression of desorption rate and repeating the same procedure above described, it is possible to achieve similar results.

The kinetic constant k can be a function of the temperature and can change with time; also the equilibrium moisture concentration $C_{s,eq}$ changes with temperature, and thus, with time. Again, even if the temperature of the product can change with time, this variation is assumed to be negligible during the time interval between one PRT and the successive, thus allowing the analytical solution of the mass balance equation.

If one PRT is made at $t=t_{j-1}$ and the successive PRT is made at $t=t_j$, the evolution of the residual moisture concentration, given in % of water and/or solvent per dried mass, is given in the interval $[t_j-t_{j-1}]$ by the integration of the following differential equation:

$$\frac{dC_S}{dt} = DR_j = -k_j(C_S - C_{S,eq,j}) \quad \text{(eq. 20)}$$

The solution of eq. 20 requires the initial condition, i.e. the value of the residual moisture $C_S$ at $t=_{j-1}$:

$$C_S=C_{S,j-1}e^{-kj(t-tj-1)}+k_jC_{S,eq,j}[t-t_{j-1}e^{-kj(t-tj-1)}] \quad \text{(eq. 21)}$$

The value of $C_{S,j-1}$ can be calculated from the time integration of eq. 20 in the previous time interval:

$$C_{S,j-1}=C_{S,j-2}e^{-kj-1(tj-1-tj-2)}++k_{j-1}C_{S,eq,j-1}[t_{j-1}-t_{j-2}e^{-kj-1(tj-1-tj-2)}] \quad \text{(eq. 22)}$$

and thus:

$$C_S=\{C_{S,j-2}e^{-kj-1(tj-1-tj-2)}++k_{j-1}C_{S,eq,j-1}[t_{j-1}-t_{j-2}e^{-kj-1(tj-1-tj-2)}]\}e^{-kj(t-tj-1)}++k_jC_{S,eq,j}[t-t_{j-1}e^{-kj(t-tj-1)}] \quad \text{(eq. 23)}$$

Similarly, $C_{S,j-2}$, that is required to get $C_{S,j-1}$, can be calculated as follow:

$$C_{S,j-2}=C_{S,j-3}e^{-kj-2(tj-2-tj-3)}++k_{j-2}C_{S,eq,j-2}[t_{j-2}-t_{j-3}e^{-kj-2(tj-2-tj-3)}] \quad \text{(eq. 24)}$$

This procedure can be iterated until the value of the residual moisture $C_{S,0}$ at the beginning of the secondary drying stage ($t=t_0$) appears:

$$C_{S,1}=C_{S,0}e^{-k1(t1-t0)}+k_1C_{S,eq,1}[t_1-t_0e^{-k1(t1-t0)}] \quad \text{(eq. 25)}$$

Thus, in the time interval between $t_j$ and $t_{j-1}$ the evolution of the residual moisture concentration can be obtained as a function of $C_{S,0}$, $C_{S,eq,r}$ (with r=1, . . . ,j) and $k_r$ (with r=1, . . . ,j).

The evolution of the theoretical value of the desorption rate in the time interval between $t_j$ and $t_{j-1}$ is given by:

$$DR_{theor}=-k_j\{C_{S,j-1}e^{-kj(t-tj-1)}++k_jC_{S,eq,j}[t-t_{j-1}e^{-kj(t-tj-1)}]-C_{S,eq,j}\} \quad \text{(eq. 26)}$$

and thus it is a function of $C_{S,0}$, $C_{S,eq,r}$ (with r=1, . . . ,j) and of $k_r$ (with r=1, . . . ,j).

If $C_{S,0}$ and the values of the various kinetic constants $k_j$ are perfectly known and the model given by eq. 20 is adequate to describe the dynamics of the system, eq. 21 can be used to know the time evolution of the residual moisture content and thus the time that is required to fulfill the requirements on the final value of the residual moisture content in the product. If the requirement is on the value of the desorption rate, eq. 26 can be used to this purpose.

The above situation is quite rare, since the value of initial moisture concentration has to be calculated by extracting samples and the various kinetic constants are never known a priori.

The method according to the invention provides calculating initial condition $C_{s,0}$ and kinetic constants performing the following steps as shown in the flowchart of FIG. 2.

Step 1

At time $t=t_0$ a PRT is performed and the desorption rate DR (indicated in the following as $DR_{exp,0}$) is calculated, e.g. using eq. 4.

From eq. 20 it is:

$$DR_{exp,0}=DR_{theor,0}=-k_0(C_{S,0}-C_{S,eq,0}) \quad \text{(eq. 27)}$$

Step 2

At time $t=t_1$ a PRT is performed and the desorption rate DR (indicated in the following as $DR_{exp,1}$) is calculated, e.g. using eq. 4.

From eq. 26 it is:

$$DR_{exp,1}=DR_{theor,1}=-k_1\{C_{S,0}e^{-k1(t1-t0)}++k_1C_{S,eq,1}[t_1-t_0e^{-k1(t1-t0)}]-C_{S,eq,1}\} \quad \text{(eq. 28)}$$

Step 3

At time $t=t_2$ a PRT is performed and the desorption rate DR (indicated in the following ad $DR_{exp,2}$) is calculated, e.g. using eq. 4.

From eq. 26 it is:

$$DR_{exp,2}=DR_{theor,2}=-k_2\{C_{S,1}e^{-k2(t2-t1)}++k_2C_{S,eq,2}[t_2-t_1e^{-k2(t2-t1)}]-C_{S,eq,2}\} \quad \text{(eq. 29)}$$

Step 4

Values of $C_{S,0}$, $k_0$, $k_1$ and $k_2$ are estimated so that the calculated values of the desorption rates matches with all the experimental values available ($DR_{exp,0}$, $DR_{exp,1}$, $DR_{exp,2}$). This can be done using a minimization algorithm to solve the following non-linear least-square problem:

$$\min_{C_{S,0},k_i} \sum_{i=0}^{2} (DR_{exp,i} - DR_{theor,i})^2 \quad \text{(eq. 30)}$$

assuming, for example, that $k_2$ is equal to $k_1$, as previously stated.

The values of $C_{S,eq,0}$, $C_{S,eq,1}$ and $C_{S,eq,2}$ must be known (from experimentation).

Step 5

Once estimated the values of $C_{S,0}$, $k_0$, $k_1$ and $k_2$, it is possible to calculate at time $t=t_2$ the residual moisture concentration $C_{S,2}$ (or the desorption rate), using eq. 20.

Step 6

The calculated value of residual moisture concentration $C_{S,2}$ is compared with a desired value of a final residual moisture concentration $C_{S,f}$.

If the calculated value of residual moisture concentration $C_{S,2}$ is lower than, or equal to, the final residual moisture concentration $C_{S,f}$, then the secondary drying phase is completed.

Step 7

If the calculated value of residual moisture concentration $C_{S,2}$ is higher than the desired final residual moisture concentration $C_{S,f}$, then using the calculated values of $C_{S,0}$ and of the kinetic constants it is possible to estimate the time $t_f$ at which the desired value of residual moisture concentration $C_{S,f}$ is obtained, assuming that the temperature of the product does not change. This can be done by using eq. 21 where $C_S$ is replaced by $C_{S,f}$ and thus t corresponds to $t_f$. In this case the following non-linear equation must be solved:

$$C_{S,f}=C_{S,2}e^{-k_2(t_f-t_2)}+k_2C_{S,eq,2}[t_f-t_2e^{-k_2(t_f-t_2)}] \quad \text{(eq. 31)}$$

A different stop criterion can be assumed, e.g. the requirement that the desorption rate DR has a certain final low value $DR_f$. For this purpose eq. 26 can be used wherein DR is replaced by final desorption rate $DR_f$.

Step 8

A new PRT is performed at time $t=t_j$ and a respective desorption rate $DR_{exp,j}$ is calculated; from eq. 26:

$$DR_{exp,j}=DR_{theor,j}=-k_j\{C_{S_{j-1}}e^{-k_j(t_j-t_{j-1})}++k_jC_{S,eq,j}[t_j-t_{j-1}e^{-k_j(t_j-t_{j-1})}]-C_{S,eq,j}\} \quad \text{(eq. 29bis)}$$

This step can be repeated several times and after each PRT a new value of DR is available and a better estimation of the values of $C_{S,0}$, $k_0$, $k_1$, . . . , $k_j$ and $t_f$ is obtained, until the end of the secondary drying phase.

For example, at time $t=t_3$ the PRT gives $DR_{exp,3}$ and from eq. 26 it is:

$$DR_{exp,3}=DR_{theor,3}=-k_3\{C_{S,2}e^{-k_3(t_3-t_2)}++k_3C_{S,eq,3}[t_3-t_2e^{-k_3(t_3-t_2)}]-C_{S,eq,3}\} \quad \text{(eq. 29ter)}$$

Step 9

Values of $C_{S,0}$, $k_0$, $k_1$, . . . , $k_j$ are estimated by solving the non-linear least-square problem:

$$\min_{C_{S,0},k_i}\sum_{i=0}^{j}(DR_{exp,i}-DR_{theor,i})^2 \quad \text{(eq. 30bis)}$$

assuming, for example, that $k_j$ is equal to $k_{j-1}$, as previously stated.

For example, at time $t=t_3$, the values $C_{S,0}$, $k_0$, $k_1$, $k_2$ and $k_3$ are calculated by solving the non-linear least-square problem:

$$\min_{C_{S,0},k_i}\sum_{i=0}^{3}(DR_{exp,i}-DR_{theor,i})^2 \quad \text{(eq. 30ter)}$$

Step 10

Once estimated the values of $C_{S,0}$, $k_0$, $k_1$, . . . , $k_j$, it is possible to calculate at time $t=t_j$ the residual moisture concentration $C_{s,j}$ using eq. 20, or the desorption rate $DR_{theor,j}$.

Step 11

The calculated value of residual moisture concentration $C_{S,j}$, or desorption rate $DR_{theor,j}$, is compared with the final residual moisture concentration $C_{S,f}$, or the final desorption rate $DR_f$.

If the estimated value of residual moisture concentration $C_{S,j}$, or desorption rate $DR_{theor,j}$, is lower than, or equal to, the final residual moisture concentration $C_{S,f}$, or the final desorption rate $DR_f$, then secondary drying phase is completed.

If the estimated value of residual moisture concentration $C_{S,j}$, or desorption rate $DR_{theor,j}$, is higher than final residual moisture concentration $C_{S,f}$, or final desorption rate $DR_f$, than step 7 is repeated with $t=t_j$ for estimating the final time $t_f$ at which the final residual moisture concentration $C_{S,f}$ (or final desorption rate $DR_f$) is obtained:

$$C_{S,f}=C_{S,j}e^{-k_j(t_f-t_j)}+k_jC_{S,eq,j}[t_f-t_je^{-k_j(t_f-t_j)}] \quad \text{(eq. 31bis)}$$

For example, at time $t=t_3$, using the calculated values of $C_{S,0}$ and of the kinetic constants it is possible to estimate the time instant $t_f$ at which the final residual moisture concentration $C_{S,f}$ is obtained, assuming that the temperature of the product does not change; the following non-linear equation must be solved:

$$C_{S,f}=C_{S,3}e^{-k_3(t_f-t_3)}+k_3C_{S,eq,3}[t_f-t_3e^{-k_3(t_f-t_3)}] \quad \text{(eq. 31ter)}$$

A different stop criterion can be assumed, e.g. the requirement that the desorption rate has a certain low value.

In the following and with reference to FIGS. 3 to 7, it is provided an example of the application of the method of the invention for monitoring a secondary drying phase of a drying process.

Figure 3:
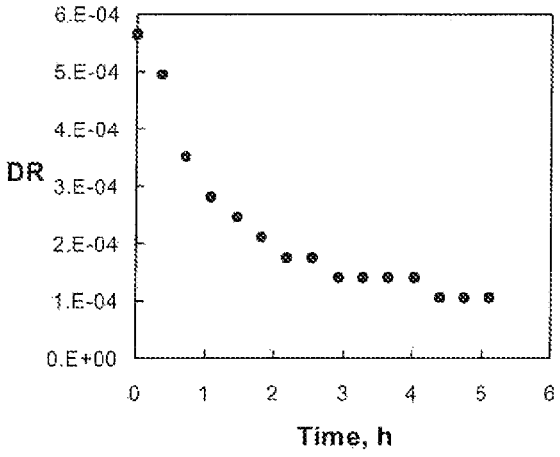
FIG. 3 is a graph showing a sequence of experimental measured values of desorption rate vs time during secondary drying.

FIG. 3 shows an experimental campaign with provides values of desorption rate vs. time during the secondary drying.

The first version of the method is used.

Step 1

At time $t=t_0=0$ s from the PRT (and eq. 4) it comes that $DR_{exp,0}=0.00056\%$ water over dried product $s^{-1}$.

Step 2

At time $t=t_1=1296$ s from the PRT (and eq. 4) it comes that $DR_{exp,1}=0.00049\%$ water $s^{-1}$.

Step 3

At time $t=t_2=2592$ s from PRT (and eq. 4) it comes that $DR_{exp,2}=0.00035\%$ water $s^{-1}$.

Step 4

Using the preliminary estimation of the kinetic constants $k_0$ and $k_1$ and of $C_{S,0}$ from eq. 17 ($k_0=k_1=1.03\cdot10^{-4}$ $s^{-1}$, $C_{S,0}=5.48\%$ water over dried product), eq. 16 is used to calculate $C_{S,0}$ and the kinetic constants ($C_{S,0}=4.13\%$ water over dried product).

Steps 5, 7

Using the calculated values of $C_{S,0}$ and of the kinetic constants and eq. 18 it is possible to estimate the time instant $t_f$ at which the desired value of final moisture concentration $C_{S,f}$ (e.g. 0.2% water over dried product) is obtained. In this case it is calculated that 25056 s are still required.

Figure 4:
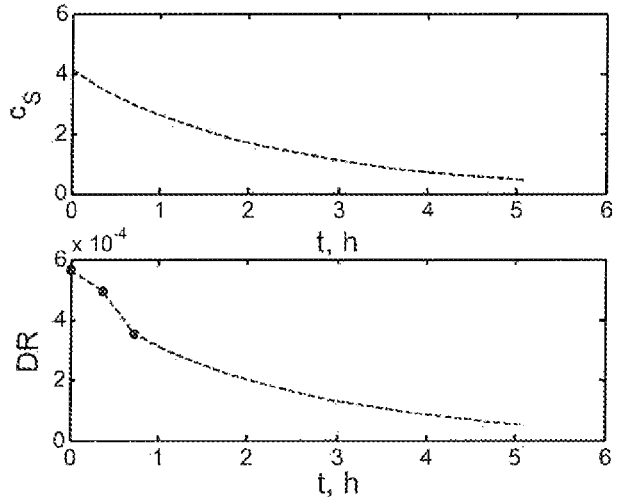
FIG. 4 are graphs showing estimation of time evolution respectively of residual moisture concentration and desorption rate of dried product at a further defined time.

FIG. 4 shows an estimation of the time evolution of the concentration $C_S$ and of the desorption rate DR obtained using the estimation of $C_{S,0}$ and of the kinetic constants.

At this point, the above described procedure can be iterated (steps 7 to 11).

At time $t=t_3=3888$ s from PRT (and eq. 4) it comes that $DR_{exp,3}=0.00028\%$ water $s^{-1}$.

Using eq. 16 it calculated $C_{S,0}=4.06\%$ water over dried product and that 26352 s are still required.

Figure 5:
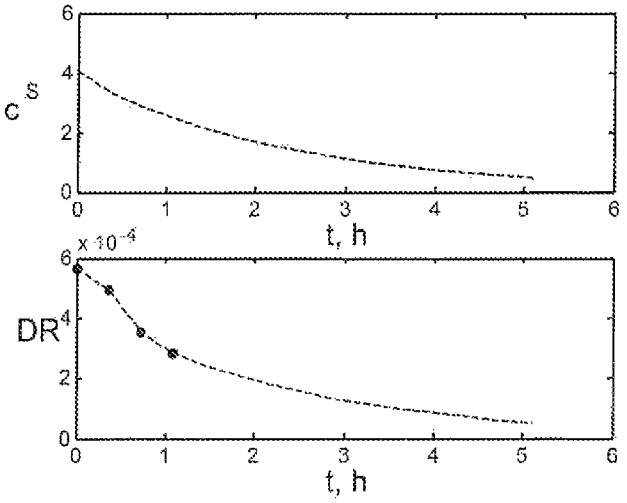
FIG. 5 are graphs showing estimation of time evolution respectively of residual moisture concentration and desorption rate of dried product at a further defined time.

FIG. 5 shows the estimation of the time evolution of the concentration $C_S$ and of the desorption rate DR obtained using the new estimation of $C_{S,0}$ and of the kinetic constants.

It is possible to see that at each iteration the estimation of the values of $C_{S,0}$ is improved, as well as the estimation of the time $t_f$ required to complete the secondary drying phase.

Figure 6:
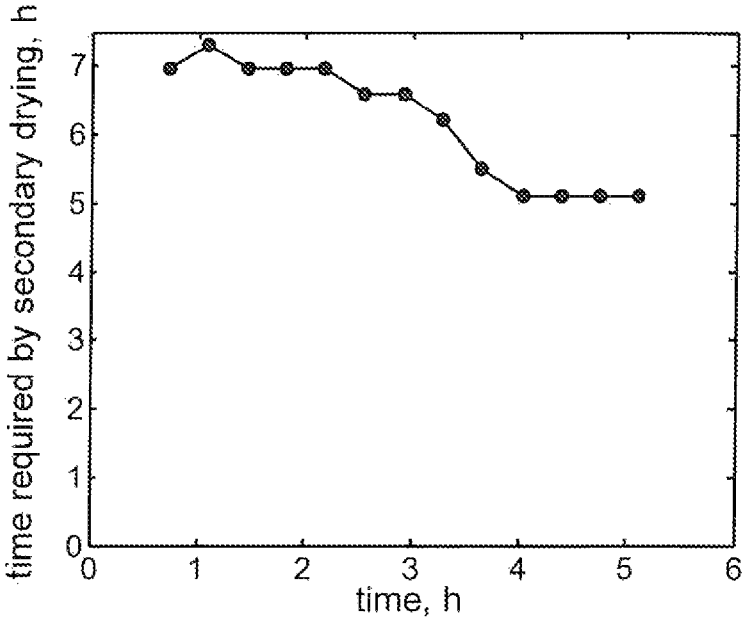
FIG. 6 is a graph showing a time evolution sequence of estimations of time required to complete secondary drying.

FIG. 6 shows how the estimate of the final time $t_f$ required to complete the secondary drying phase changes with time.

Figure 7:
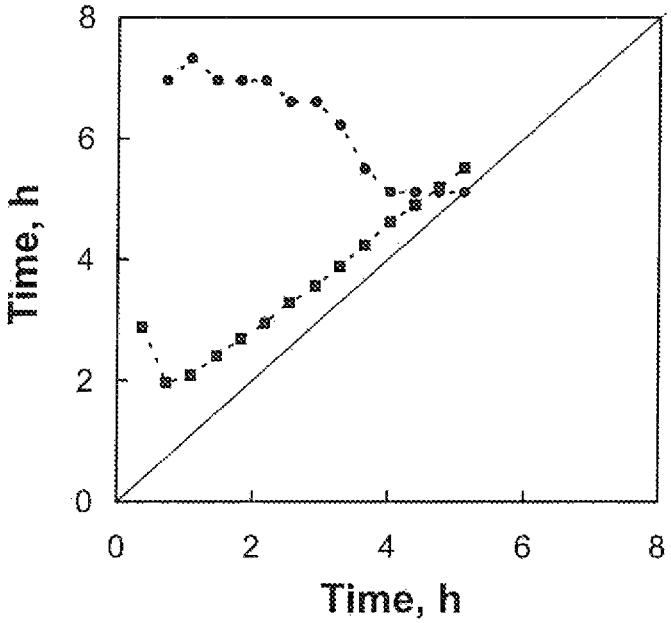
FIG. 7 illustrates a comparison between estimations of time required to complete secondary drying obtained using the method of the invention and using the method according to U.S. Pat. No. 6,176,121.

FIG. 7 illustrates a comparison between estimations of final time $t_f$ required to complete the secondary drying phase (end-points of secondary drying phase) using the method of the invention (broken line with round dots) and using the method according to the U.S. Pat. No. 6,176,121 (broken line with square dots).

It is possible to see that the estimations of the time required to get the end of the secondary drying using the method of the invention is quite good even at the beginning of the phase and is refined as the secondary drying goes on. On the contrary, using the method disclosed in U.S. Pat. No.

6,176,121 the prediction of the time required to complete secondary drying is not reliable at the beginning and after each PRT the prediction is updated until the end of the drying is obtained.

The method of the invention was also validated by means of a series of experiments carried out in laboratory.

Figure 8:
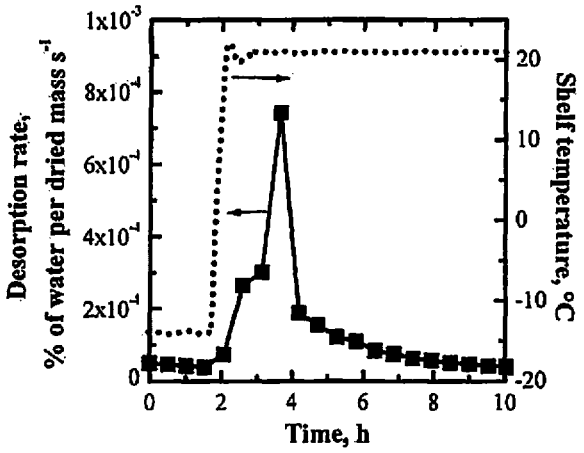
FIGS. 8 and 9 show a comparison between experimental values and values predicted by the method of the invention respectively of the desorption rate and of the residual water content.
Figure 9:
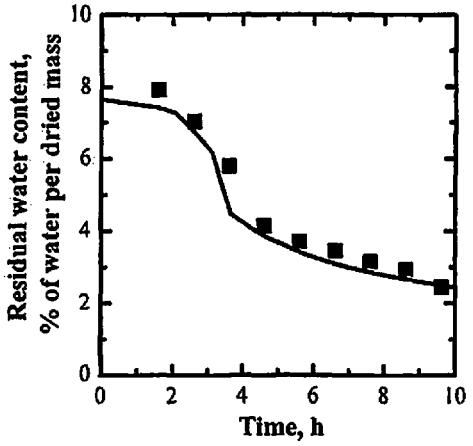

FIGS. 8 and 9 are an example of the results that can be obtained with the algorithm of the method are used.

In particular, FIGS. 8 and 9 are a comparison between the experimental values (symbols) and those predicted by the algorithm of the invention (solid line) respectively of the desorption rate (FIG. 8) and of the residual water content (FIG. 9). The time evolution of a shelf temperature is also shown (FIG. 8, dotted line). Time is equal to zero at the beginning of the secondary drying.

The example refers to a freeze-drying cycle of an aqueous solution of sucrose at 20% by weight (155 vials having a diameter of $20.85 \cdot 10^{-3}$ m, filled with $3 \cdot 10^{-3}$ 1 of solution). The freezing phase was carried out at −50° C. for 17 h, primary drying phase was carried out at −15° C. and 10 Pa for 25 h and secondary drying phase was carried out at 20° C.

The experimental values of desorption rate have been obtained by means of the Pressure Rise Test (see eq. (4)), while the residual water content was determined by weighing some vials taken from the drying chamber using a sample thief.

The kinetic model for the desorption of water that was used by the algorithm is the same of the first version of the method (eq. 5-18), i.e. the desorption rate was assumed to be proportional to the residual water content.

The time evolution of the desorption rate is a consequence of the fact that when secondary drying is started the shelf temperature is increased and, during this time interval, the product temperature, and thus the desorption rate, increases. After this, the temperature remains constant and, due to the lowering of the residual water content, the desorption rate decreases.

The invention claimed is:

1. Method for calculating a residual moisture concentration and/or desorption rate of a product during a secondary drying phase of a freeze-drying process in a freeze-dryer apparatus including a drying chamber and a condenser chamber where vapour generated by drying process flows, said apparatus being provided with a pressure sensor that can be isolated for performing pressure rise tests and measuring a total pressure inside said drying chamber, said method comprising the steps of:

a) setting a desired final residue moisture concentration and/or a desired final desorption rate of said product;

b) measuring initial residual moisture concentration and/or desorption rate and estimating kinetic constants of a kinetic model of the drying process, said kinetic model being suitable for calculating the residual moisture concentration and/or desorption rate of said product;

c) closing a valve placed on a duct connecting said drying chamber to said condenser chamber for a preselected period of time;

d) measuring a pressure change in said drying chamber;

e) calculating a desorption rate from the closing time period of step c) and the pressure change of step d);

f) repeating steps c)-e) to calculate residual moisture concentrations and/or desorption rates at pre-specified time intervals;

g) integrating the calculated residual moisture concentrations and/or desorption rate from said initial conditions to the calculated residual moisture concentrations and/or desorption rates of the pre-specified time intervals of step e) to determine a current residual moisture concentration of the drying product;

wherein if said current residual moisture concentration and/or said current final desorption rate is lower than or equal to said desired residual moisture concentration and/or to said desired desorption rate then said secondary drying phase ends, and wherein a first pressure rise test at time $t=t_0$ at the beginning of the secondary drying phase is performed and a first value of experimental desorption rate ($DR_{exp,\ 0}$) of said product is calculated using the equation:

$$DR_{exp} = \frac{VM_w}{RT}\left(\frac{dP}{dt}\right)_{t=t_0}\frac{100}{m_{dried}} \quad \text{(eq. 4)}$$

where:

$DR_{exp}$: experimental desorption rate, [% water and/or solvent $s^{-1}$]

P: measured pressure, [Pa]

t: time, [s]

$t_0$: time instant at the beginning of the pressure rise test, [s]

R: gas constant [8,314 J $mol^{-1}$ $K^{-1}$]

T: temperature of the vapour, [K]

V: (free) volume of drying chamber, [$m^3$]

$M_w$: molecular weight of water and/or solvent, [kg $mol^{-1}$]

$m_{dried}$: mass of the dried product, [kg]

a second pressure rise test at a successive time $t=t_1$ is performed and a second value of experimental desorption rate ($DR_{exp,\ 1}$) of said product is calculated using the equation:

$$DR_{exp} = \frac{VM_W}{RT}\left(\frac{dP}{dt}\right)_{t=t_0}\frac{100}{m_{dried}}; \quad \text{(eq. 4)}$$

a third pressure rise test at time $t=t_2$ is performed and a third value of experimental desorption rate ($DR_{exp,\ 2}$) of said product is calculated using the equation eq. 4

$$DR_{exp} = \frac{VM_W}{RT}\left(\frac{dP}{dt}\right)_{t=t_0}\frac{100}{m_{dried}}; \quad \text{(eq. 4)}$$

and wherein said initial conditions ($C_{S,0}$) and kinetic constants ($k_0$, $k_1$, $k_2$) of a kinetic model of the drying process, said kinetic model being suitable for calculating a residual moisture content ($C_S$) and/or desorption rate ($DR_{theor}$) of said product are calculated using the equations:

$$DR_{exp,0}=DR_{theor,0}=-k_0C_{S,0} \quad \text{(eq. 13)}$$

$$DR_{exp,1}=DR_{theor,1}=-k_1C_{S,0}e^{-k_1(t_1-t_0)} \quad \text{(eq. 14)}$$

$$DR_{exp,2}=DR_{theor,2}=-k_2C_{s,0}e^{-k_1(t_1-t_0)}e^{-k_2(t_2-t_1)} \quad \text{(eq. 15)}$$

where:

$DR_{exp,j}$: experimental desorption rate at time tj, [% water and/or solvent $s^{-1}$]

$DR_{theor,j}$: desorption rate (theoretical value) at time tj [% water and/or solvent $s^{-1}$]

$C_{S,0}$: value of the residual moisture [% water and/or solvent over dried product] at the beginning of the secondary drying phase ($t=t_0$);

$k_j$: kinetic constant of the process at time $t=t_j$ (with j=0, 1, 2), [$s^{-1}$];

and a minimisation algorithm to solve the minimum least square problem described by equation:

$$\min_{C_{S,0},k_i} \sum_{i=0}^{2} (DR_{exp,i} - DR_{theor,i})^2 \quad \text{(eq. 16)}$$

calculating at time $t=t_2$ a respective residual moisture content ($C_{S,2}$) and a respective desorption rate ($DR_{theor,2}$) (step 5) respectively using the equations:

$$C_S = C_{S,0} \prod_{i=1}^{j-1} e^{-k_i(t_i-t_{i-1})} e^{-k_j(t-t_{j-1})} \quad \text{(eq. 11)}$$

$$DR_{theor} = -k_j C_{S,0} \prod_{i=1}^{j-1} e^{-k_i(t_i-t_{i-1})} e^{-k_j(t-t_{j-1})}. \quad \text{(eq. 12)}$$

2. Method according to claim 1, further comprising after step 5 the steps of:

comparing said residual moisture content ($C_{S,2}$) and/or said desorption rate ($DR_{theor,2}$) calculated at time $t=t_2$ respectively with a desired final residual moisture concentration ($C_{S,f}$) and/or a desired final desorption rate ($DR_f$) (step 6); if said residual moisture content ($C_{S,2}$) is lower than, or equal to, said final residual moisture concentration ($C_{S,f}$) or said desorption rate ($DR_{theor,2}$) is lower than, or equal to, said final desorption rate ($DR_f$), then the secondary drying phase is considered ended; if not the method further comprising the steps of:

estimating a final time ($t_f$) at which said final residual moisture concentration ($C_{S,f}$) or said final desorption rate ($DR_f$) is obtained (step 7);

performing a further pressure rise test at time $t=t_j$ and calculating at said time $t=t_j$ a respective residual moisture content ($C_{S,j}$) and a respective desorption rate ($DR_{theor,j}$) (step 8);

estimating initial conditions ($C_{S,0}$) and kinetic constants ($k_0, k_1, k_2, \ldots, k_j$) of said kinetic model (step 9);

calculating at said time $t=t_j$ a respective residual moisture content ($C_{S,j}$) and/or a respective desorption rate ($DR_{theor,j}$) (step 10);

comparing said residual moisture content ($C_{S,j}$) and/or said desorption rate ($DR_{theor,j}$) calculated at said time $t=t_j$ respectively with said final residual moisture concentration ($C_{S,f}$) and/or said final desorption rate ($DR_f$) (step 11); if said residual moisture content ($C_{S,j}$) is lower than, or equal to, said final residual moisture concentration ($C_{S,f}$) or said desorption rate ($DR_{theor,j}$) is lower than, or equal to, said final desorption rate ($DR_f$) then the secondary drying phase is considered ended; if not steps 7 to 11 are repeated.

3. Method according to claim 2, wherein said experimental desorption rates ($DR_{exp,O}$, $DR_{exp,1}$, $DR_{exp,2}$) are calculated using the equation:

$$DR_{exp} = \frac{VM_W}{RT}\left(\frac{dP}{dt}\right)_{t=t_0} \frac{100}{m_{dried}} \quad \text{(eq. 4)}$$

where:

$DR_{exp}$: experimental desorption rate, [% water and/or solvent $s^{-1}$]

P: measured pressure, [Pa]

t: time, [s]

$t_0$: time instant at the beginning of the pressure rise test, [s]

R: gas constant [8,314 J $mol^{-1}$ $K^{-1}$]

T: temperature of the vapour, [K]

V: (free) volume of drying chamber, [$m^3$]

$M_w$: molecular weight of water and/or solvent, [kg $mol^{-1}$]

$m_{dried}$: mass of the dried product, [kg].

4. Method according to claim 3, wherein said kinetic model comprises mathematical equations suitable for modeling the dependence of the desorption rate (DR) on the residual moisture content ($C_S$) in the product.

5. Method according to claim 3, wherein said desorption rate is assumed to depend on said residual moisture content in said product according to the equation:

$$DR = -kC_S \quad \text{(eq. 5)}$$

where:

DR: desorption rate, [% water and/or solvent $s^{-1}$]

k: kinetic constant of the process, [$s^{-1}$]

$C_S$: residual moisture content, [% water/solvent over dried product].

6. Method according to claim 5, wherein a time evolution of said residual moisture concentration ($C_S$) at time $t=t_j$ is given by the integration of the following differential equation:

$$\frac{dC_S}{dt} = DR_j = -k_j C_S \quad \text{(eq. 7)}$$

where:

$DR_j$: desorption rate at time $t=t_j$, [% water and/or solvent $s^{-1}$]

t: time, [s]

$k_j$: kinetic constant of the process at time $t=t_j$, [$s^{-1}$].

7. Method according to claim 6, wherein said calculating a residual moisture content ($C_s$) is made by means of the equation:

$$C_S = C_{S,0} \prod_{i=1}^{j-1} e^{-k_i(t_i-t_{i-1})} e^{-k_j(t-t_{j-1})} \quad \text{(eq. 11)}$$

where:

$C_{S,0}$: value of the residual moisture [% water and/or solvent over dried product] at the beginning of the secondary drying phase ($t=t_0$);

$k_r$: kinetic constant of the process at time $t=t_r$ (with r=1, 2, . . . , j), [$s^{-1}$].

8. Method according to claim 7, wherein said calculating a desorption rate ($DR_{theor}$) is made by means of the equation:

$$DR_{theor} = -k_j C_{S,0} \prod_{i=1}^{j-1} e^{-k_i(t_i - t_{i-1})} e^{-k_j(t - t_{j-1})}. \quad \text{(eq. 12)}$$

9. Method according to claim 8, wherein said estimating initial conditions ($C_{S,0}$) and kinetic constants ($k_0$, $k_1$, $k_2$, . . . , $k_j$), at time $t=t_j$, is made by means of the following equations:

$$DR_{exp,0} = DR_{theor,0} = -k_0 C_{S,0} \quad \text{(eq. 13)}$$

$$DR_{exp,1} = DR_{theor,1} = -k_1 C_{S,0} e^{-k_1(t_1 - t_0)} \quad \text{(eq. 14)}$$

$$DR_{exp,2} = DR_{theor,2} = -k_2 C_{s,0} e^{-k_1(t_1 - t_0)} e^{-k_2(t_2 - t_1)} \quad \text{(eq. 15)}$$

$$DR_{exp,j} = DR_{theor,j} = \quad \text{(eq. 15bis)}$$

$$= -k_j C_{S,0} \prod_{i=1}^{j-1} e^{-k_i(t_i - t_{i-1})} e^{-k_j(t_j - t_{j-1})}$$

and solving the following non-linear least square problem:

$$\min_{C_{S,0}, k_i} \sum_{i=0}^{j} (DR_{exp,i} - DR_{theor,i})^2. \quad \text{(eq. 16bis)}$$

10. Method according to claim 7, wherein said final time ($t_f$) is calculated, assuming that temperature of said product does not change, by means of the following equation, resulted from (eq. 11):

$$t_f = t_j - \frac{1}{k_j} \ln\left(\frac{C_{S,f}}{C_{S,j}}\right) \quad \text{(eq. 18bis)}$$

where:

$C_{S,f}$: final residual moisture concentration [% water and/or solvent over dried product];

$C_{S,j}$: residual moisture concentration at time $t=t_j$ [% water and/or solvent over dried product].

11. Method for calculating a residual moisture concentration and/or desorption rate of a product during a secondary drying phase of a freeze-drying process in a freeze-dryer apparatus including a drying chamber and a condenser chamber where vapour generated by drying process flows, said apparatus being provided with a pressure sensor that can be isolated for performing pressure rise tests and measuring a total pressure inside said drying chamber, said method comprising the steps of:

a) setting a desired final residue moisture concentration and/or a desired final desorption rate of said product;

b) measuring initial residual moisture concentration and/or desorption rate and estimating kinetic constants of a kinetic model of the drying process, said kinetic model being suitable for calculating the residual moisture concentration and/or desorption rate of said product;

c) closing a valve placed on a duct connecting said drying chamber to said condenser chamber for a preselected period of time;

d) measuring a pressure change in said drying chamber;

e) calculating a desorption rate from the closing time period of step c) and the pressure change of step d);

f) repeating steps c)-e) to calculate residual moisture concentration and/or desorption rate at pre-specified time intervals;

g) integrating the calculated residual moisture concentration and/or desorption rate from said initial conditions to the calculated residual moisture concentration and/or desorption rates of the pre-specified time intervals of step e) to determine a current residual moisture of the drying product;

wherein if said current residual moisture concentration and/or said current final desorption rate is lower than or equal to said desired residual moisture concentration and/or said desired desorption rate then said secondary drying phase ends, and wherein a first pressure rise test at time $t=t_0$ at the beginning of the secondary drying phase is performed and a first value of experimental desorption rate ($DR_{exp,\ 0}$) of said product is calculated using the equation:

$$DR_{exp} = \frac{VM_W}{RT}\left(\frac{dP}{dt}\right)_{t=t_0} \frac{100}{m_{dried}} \quad \text{(eq. 4)}$$

where:

$DR_{exp}$: experimental desorption rate, [% water and/or solvent $s^{-1}$]

P: measured pressure, [Pa]

t: time, [s]

$t_0$: time instant at the beginning of the pressure rise test, [s]

R: gas constant [8,314 J $mol^{-1}$ $K^{-1}$]

T: temperature of the vapour, [K]

V: (free) volume of drying chamber, [$m^3$]

$M_w$: molecular weight of water and/or solvent, [kg $mol^{-1}$]

$m_{dried}$: mass of the dried product, [kg]

a second pressure rise test at a successive time $t=t_1$ is performed and a second value of experimental desorption rate ($DR_{exp,\ 1}$) of said product is calculated using the equation:

$$DR_{exp} = \frac{VM_W}{RT}\left(\frac{dP}{dt}\right)_{t=t_0} \frac{100}{m_{dried}}; \quad \text{(eq. 4)}$$

a third pressure rise test at time $t=t_2$ is performed and a third value of experimental desorption rate ($DR_{exp,\ 2}$) of said product is calculated using the equation eq. 4

$$DR_{exp} = \frac{VM_W}{RT}\left(\frac{dP}{dt}\right)_{t=t_0} \frac{100}{m_{dried}}; \quad \text{(eq. 4)}$$

and wherein said initial conditions ($C_{S,0}$) and kinetic constants ($k_0$, $k_1$, $k_2$) of a kinetic model of the drying process, said kinetic model being suitable for calculating a residual moisture content ($C_S$) and/or desorption rate ($DR_{theor}$) of said product are calculated using the equations:

$$DR_{exp,0} = DR_{theor,0} = -k_0(C_{S,0} - C_{S,eq,0}) \quad \text{(eq. 27)}$$

$$DR_{exp,1} = DR_{theor,1} = -k_1\{C_{S,0} e^{-k_1(t_1 - t_0)} + + k_1 C_{S,eq,1}[t_1 - t_0 e^{-k_1(t_1 - t_0)}] - C_{S,eq,1}\} \quad \text{(eq. 28)}$$

$$DR_{exp,2} = DR_{theor,2} = -k_2\{C_{S,1} e^{-k_2(t_2 - t_1)} + + k_2 C_{S,eq,2}[t_2 - t_1 e^{-k_2(t_2 - t_1)}] - C_{S,eq,2}\} \quad \text{(eq. 29)}$$

where $DR_{exp,j}$: experimental desorption rate at time tj, [% water and/or solvent $s^{-1}$]

$C_{s,eq,j}$ equilibrium moisture concentration at time tj [% water and/or solvent $s^{-1}$]:

$C_{S,0}$: value of the residual moisture [% water and/or solvent over dried product] at the beginning of the secondary drying phase ($t=t_0$);

$k_j$: kinetic constant of the process at time $t=t_j$ (with j=0, 1, 2), [$s^{-1}$]. and a minimisation algorithm to solve the minimum least square problem described by equation:

$$\min_{C_{S,0},k_i} \sum_{i=0}^{2} (DR_{exp,i} - DR_{theor,i})^2 \quad \text{(eq. 30)}$$

calculating at time $t=t_2$ a respective residual moisture content ($C_{S,2}$) and a respective desorption rate ($DR_{theor,\,2}$) (step 5) using for calculating the residual moisture content ($C_{S,2}$) the equations:

$$C_S=C_{S,j-1}e^{-kj(t-tj-1)}++k_jC_{S,eq,j}[t-t_{j-1}e^{-kj(t-tj-1)}] \quad \text{(eq. 21)}$$

$$C_{S,j-1}=C_{S,j-2}e^{-kj-1(tj-1-tj-2)}++k_{j-1}C_{S,eq,j-1}[t_{j-1}-t_{j-2}e^{-kj-1(tj-1-tj-2)}] \quad \text{(eq. 22)}$$

$$C_{S,j-2}=C_{S,j-3}e^{-kj-2(tj-2-tj-3)}++k_{j-2}C_{S,eq,j-2}[t_{j-2}-t_{j-3}e^{-kj-2(tj-2-tj-3)}] \quad \text{(eq. 24)}$$

$$C_{S,1}=C_{S,0}e^{-k1(t1-t0)}+k_1C_{S,eq,1}[t_1-t_0e^{-k1(t1-t0)}] \quad \text{(eq. 25)}$$

where:

$C_{S,0}$: value of the residual moisture [% water and/or solvent over dried product] at the beginning of the secondary drying phase ($t=t_0$);

$k_r$: kinetic constant of the process at time $t=t_r$ (with r=1, 2, . . . , j), [$s^{-1}$];

$C_{s,eq,r}$: equilibrium moisture concentration at time $t=t_r$ with r=1, 2, . . . , j), [% water and/or solvent over dried product];

and using for calculating the respective desorption rate ($DR_{theor,\,2}$) the equation:

$$DR_{theor}=-k_j\{C_{S_{j-1}}e^{-kj(t-tj-1)}++k_jC_{S,eq,j}[t-t_{j-1}e^{-kj(t-tj-1)}]-C_{S,eq,j}\} \quad \text{(eq. 26).}$$

12. Method according to claim 11, wherein said desorption rate ($DR_{theor}$) is assumed to depend on said residual moisture content ($C_S$) in said product according to the equation:

$$DR=-k(C_S-C_{S,eq}) \quad \text{(eq. 19)}$$

where:

DR: desorption rate, [% water and/or solvent $s^{-1}$]

k: kinetic constant of the process, [$s^{-1}$]

$C_S$: residual moisture concentration, [% water and/or solvent over dried product]

$C_{s,eq}$: equilibrium moisture concentration, [% water and/or solvent over dried product].

13. Method according to claim 12, wherein a time evolution of said residual moisture concentration ($C_S$) at time $t=t_j$ is given by the integration of the following differential equation:

$$\frac{dC_S}{dt} = DR_j = -k_j(C_S - C_{S,eq,j}) \quad \text{(eq. 20)}$$

where:

$DR_j$: desorption rate at time $t=t_j$, [% water and/or solvent $s^{-1}$]

t: time, [s]

$k_1$: kinetic constant of the process, [$s^{-1}$], $C_{s,eq,j}$: equilibrium moisture concentration at time $t=t_j$, [% water and/or solvent over dried product].

14. Method according to claim 13, wherein said calculating a residual moisture content ($C_S$) at time $t=t_j$ is made by means of the following equations:

$$C_S=C_{S,j-1}e^{-kj(t-tj-1)}+-k_jC_{S,eq,j}[t-t_{j-1}e^{-kj(t-tj-1)}] \quad \text{(eq. 21)}$$

and $$C_{S,j-1}=C_{S,j-2}e^{-kj-1(tj-1-tj-2)}++k_{j-1}C_{S,eq,j-1}[t_{j-1}-t_{j-2}e^{-kj-1(tj-1-tj-2)}] \quad \text{(eq. 22)}$$

$$C_{S,j-2}=C_{S,j-3}e^{-kj-2(tj-2-tj-3)}++k_{j-2}C_{S,eq,j-2}[t_{j-2}-t_{j-3}e^{-kj-2(tj-2-tj-3)}] \quad \text{(eq. 24)}$$

$$C_{S,1}=C_{S,0}e^{-k1(t1-t0)}+k_1C_{S,eq,1}[t_1-t_0e^{-k1(t1-t0)}] \quad \text{(eq. 25)}$$

where:

$C_{S,0}$: value of the residual moisture [% water and/or solvent over dried product] at the beginning of the secondary drying phase ($t=t_0$);

$k_r$: kinetic constant of the process at time $t=t_r$ (with r=1, 2, . . . , j), [$s^{-1}$];

$C_{s,eq,r}$: equilibrium moisture concentration at time $t=t_r$ with r=1, 2, . . . , j), [% water and/or solvent over dried product].

15. Method according to claim 14, wherein said calculating a desorption rate ($DR_{theor}$) is made by means of the equation:

$$DR_{theor}=-k_j\{C_{S,j-1}e^{-kj(t-tj-1)}++k_jC_{S,eq,j}[t-t_{j-1}e^{-kj(t-tj-1)}]-C_{S,eq,j}\} \quad \text{(eq. 26)}$$

16. Method according to claim 15, wherein said experimental desorption rates ($DR_{exp,0}$, $DR_{exp,1}$, $DR_{exp,2}$) are calculated using the equation:

$$DR_{exp} = \frac{VM_w}{RT}\left(\frac{dP}{dt}\right)_{t=t_0}\frac{100}{m_{dried}} \quad \text{(eq. 4)}$$

where:

$DR_{exp}$: experimental desorption rate, [% water and/or solvent $s^{-1}$]

P: measured pressure, [Pa]

t: time, [s]

$t_0$: time instant at the beginning of the pressure rise test, [s]

R: gas constant [8,314 J $mol^{-1}$ $K^{-1}$]

T: temperature of the vapour, [K]

V: (free) volume of drying chamber, [$m^3$]

$M_w$: molecular weight of water and/or solvent, [kg $mol^{-1}$]

$m_{dried}$: mass of the dried product, [kg]

and wherein said estimating initial conditions ($C_{S,0}$) and kinetic constants ($k_0$, $k_1$, $k_2$, . . . , $k_j$), at time $t=t_j$, is made by means of the following equations:

$$DR_{exp,0}=DR_{theor,0}=-k_0(C_{S,0}-C_{S,eq,0}) \quad \text{(eq. 27)}$$

$$DR_{exp,1}=DR_{theor,1}=-k_1\{C_{S,0}e^{-k_1(t_1-t_0)}++k_1C_{S,eq,1}[t_1-t_0e^{-k_1(t_1-t_0)}]-C_{S,eq,1}\} \quad \text{(eq. 28)}$$

$$DR_{exp,2}=DR_{theor,2}=-k_2\{C_{S,1}e^{-k_2(t_2-t_1)}++k_2C_{S,eq,2}[t_2-t_1e^{-k_2(t_2-t_1)}]-C_{S,eq,2}\} \quad \text{(eq. 29)}$$

$$DR_{exp,j}=DR_{theor,j}=-k_j\{C_{S_{j-1}}e^{-kj(tj-tj-1)}++k_jC_{S,eq,j}[t_j-t_{j-1}e^{-kj(tj-tj-1)}]-C_{S,eq,j}\} \quad \text{(eq. 29ter)}$$

and solving the following non-linear least square problem:

$$\min_{C_{S,0},k_i} \sum_{i=0}^{j} (DR_{exp,i} - DR_{theor,i})^2. \quad \text{(eq. 30bis)}$$

17. Method according to claim 16, wherein said final time ($t_f$) is calculated, assuming that a temperature of said product does not change, by means of the following equation, resulted from (eq. 21):

$$C_{S,f}=C_{S,j}e^{-kj(tf-tj)}++k_jC_{S,eq,j}[t_f-t_je^{-kj(tf-tj)}] \quad \text{(eq. 31bis)}$$

where:

$C_{S,f}$: final residual moisture concentration [% water and/or solvent over dried product];

$C_{S,j}$: residual moisture concentration at time $t=t_j$ [% water and/or solvent over dried product].

* * * * *